United States Patent [19]

Muench, Jr. et al.

[11] Patent Number: 4,532,386

[45] Date of Patent: Jul. 30, 1985

[54] DUAL VOLTAGE SWITCH

[75] Inventors: Frank J. Muench, Jr., Waukesha; John M. Makal, Milwaukee, both of Wis.

[73] Assignee: RTE Corporation, Waukesha, Wis.

[21] Appl. No.: 539,204

[22] Filed: Oct. 5, 1983

[51] Int. Cl.[3] ..... H01H 19/58

[52] U.S. Cl. ..... 200/11 TC; 200/336

[58] Field of Search ..... 200/11 TC, 307, 155 R, 200/282, 336; 336/147, 150; 361/268

[56] References Cited

U.S. PATENT DOCUMENTS

| | | | |
|---|---|---|---|
| 3,005,882 | 10/1961 | White | 336/147 X |
| 3,531,861 | 10/1970 | Goldbeck | 200/282 |
| 3,715,543 | 2/1973 | Keto et al. | 200/155 R |
| 3,992,595 | 11/1976 | Eley | 200/11 TC |

*Primary Examiner*—A. D. Pellinen
*Assistant Examiner*—Morris Ginsburg

[57] ABSTRACT

A dual voltage under oil transformer switch formed from one or more phase switch units, fuse switch units and/or auxiliary switch units, each switch unit including a standardized molded switch block, shaft and rotor, the switch blocks including a contact deck for supporting a number of contact blades in a common plane, the rotor including a number of bridge contacts each having a number of double-bladed contact fingers for electrically engaging the contact blades, the rotor being mounted for axial movement on the shaft to accommodate variations in the planar position of the bridge contacts, the shafts being adopted for interlocking engagements and an operating handle assembly for positively locating and indicating the position of the switch position of the rotor in its switch block, the operating handle assembly, switch block, rotor and shafting having physical index members to assure proper interconnection of the switch units.

19 Claims, 25 Drawing Figures

DUAL VOLTAGE SWITCH

BACKGROUND OF THE INVENTION

Dual voltage, series-parallel switches are available in various forms for connecting windings of a transformer into either a series or parallel connection. Each winding in the transformer is generally made up of three coil segments. The leads to each coil segment being connected to the fixed contacts on the dual voltage switch block. A rotor, having two bridge contacts, is provided within the switch block to selectively connect the fixed contacts in either a series or parallel relation. One switch assembly is generally provided for each phase and additional switch assemblies connected to the first switch assembly for each additional phase in the transformer. In addition, back-deck assemblies can also be provided to include different fuses and/or auxiliary tap coil segments into the series-parallel circuits as required by the transformer rating.

Dual voltage switches presently available are generally complex, including specially formed pinch contacts to join with the leads for the coil segments, expensive insert molded machined studs and bridging contact subassemblies which are movable to various positions to interconnect the contact leads. Where multiple phase units are required, the switches are stacked together with spacers glued to the switches to hold them together. In some instances molded spacers are used with threaded fasteners to provide a mechanical connection. Where individual phase decks are used, they have been mounted on an outside frame. Interconnection of the rotors has resulted in inconsistent connections between the rotor contacts and switch contacts because of the different type of switches used to provide the various switch functions.

SUMMARY OF THE INVENTION

The dual voltage transformer switch, according to the present invention, is formed from a number of standardized switch units, which are assembled from uniform molded parts for easy interconnection. Single, double or triple phase switches with corresponding back-deck units can be quickly and easily assembled. Each switch unit includes a switch block, a rotor and a shaft which are interchangeable to form either switch or back deck units when assembled together. Tolerance variations are compensated for by allowing the rotor to move axially on the shaft to assure switch contact. The shaft in each switch unit interlocks with the adjacent shafts to form a single rigid shaft throughout the entire dual voltage switch. Spacing between switch units is provided by standardized spacers to positively locate each switch block in a predetermined relation to the next switch block. With this arrangement, all units are firmly connected together. All of the movable parts are solidly keyed and locked together to prevent any lagging between motion from one rotor to the next and/or mispositioning of the contacts. Maximum electrical contact is assured by providing spring pressure between the rotor bridge contacts and the fixed contact blades on the switch block. The bridge contacts provided on the rotor also have spring characteristics to take up any tolerance variations between the rotor and the switch block. Ease of assembly of the leads to the contact blades on the switch block is achieved by providing hex head keepers on the contact deck of the switch block to lock the bolt heads in position during assembly. Because of the standardization of parts, the basic components with slight modifications can be combined to make single phase, double phase, or triple phase dual voltage switches. The switch unit can be easily converted to a tap changer by using a different index plate and changing one contact on the back plate. Positive location of the operating handle for the rotors is provided by an index plate located on the front of the first switch block in the dual voltage switch. The handle and index plate can be color coded to provide visual identification of the position of the switch from the ground.

IN THE DRAWINGS

DESCRIPTION OF THE INVENTION

Figure 1:
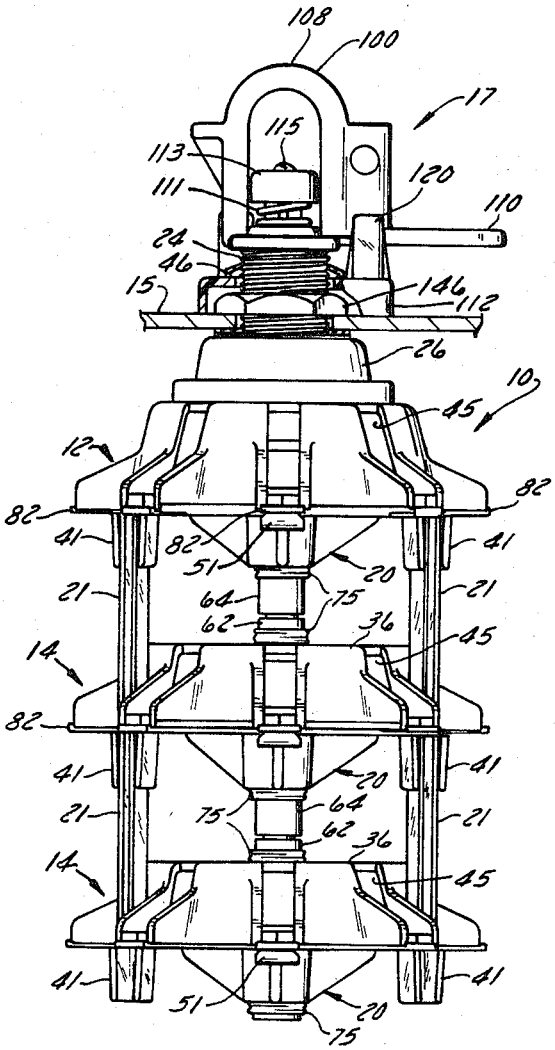
FIG. 1 is an elevation view of a three phase dual voltage switch according to the present invention.
Figure 3A:
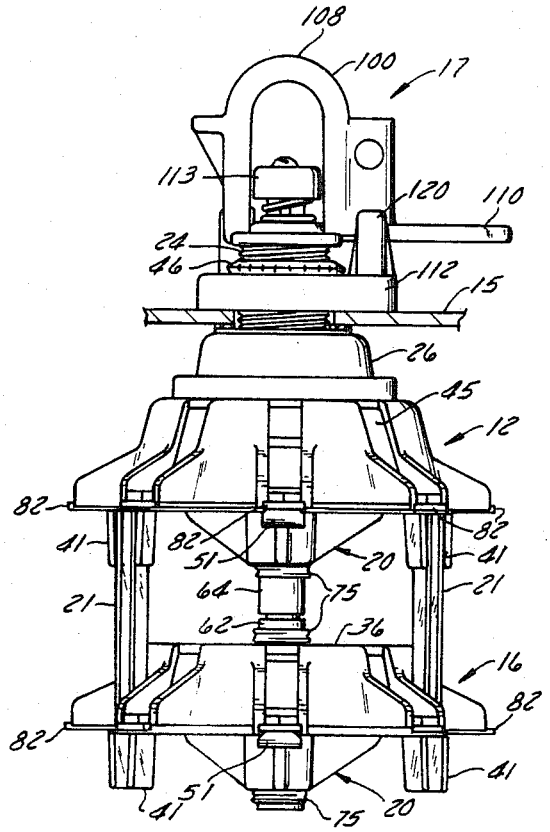
FIG. 3A is an elevation view of a phase switch unit as shown in FIG. 3 having a fuse and/or an auxiliary coil back deck switch unit mounted thereon.
Figure 2:
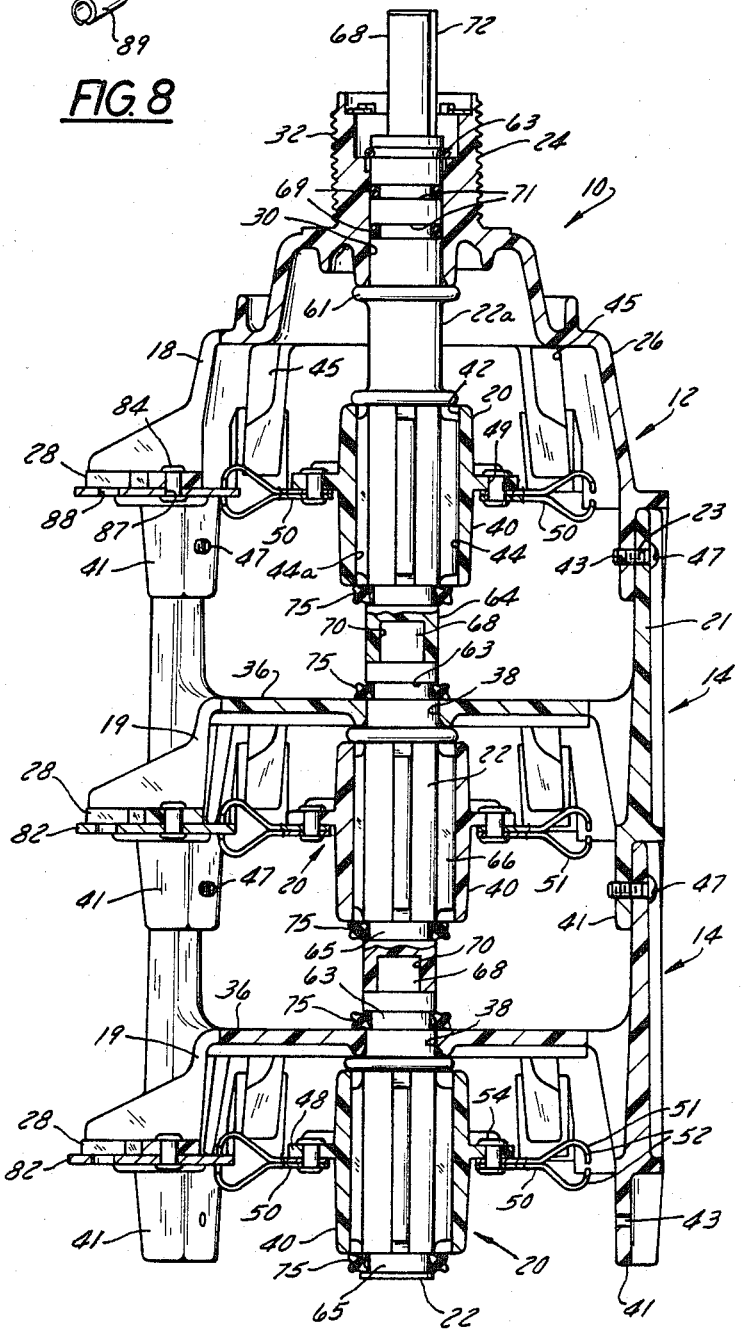
FIG. 2 is a cross section view in elevation of the three phase switch shown in FIG. 1.
Figure 19:
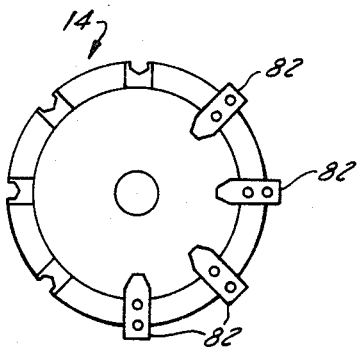
FIG. 19 is a view similar to FIG. 18 showing a contact blade deck for a high or low fuse back deck unit.
Figure 20:
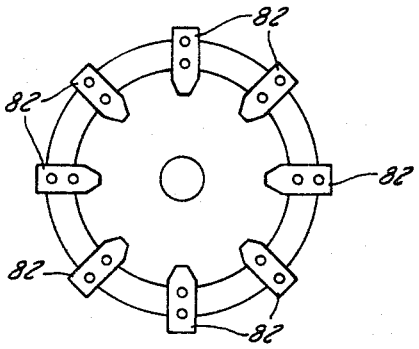
FIG. 20 is a view similar to FIG. 18 showing a double-back plate deck for the fuses and the auxiliary tap coils.

Referring to the drawings, a three phase dual voltage switch 10 of a type contemplated by the present invention is shown in FIGS. 1 and 2. As seen in these Figures, the switch 10 includes a single phase mounting switch unit 12 and two single phase switch units 14. It should be understood that the switch 10 can include one, two or three switch units for single, double or triple phase applications. Each of the switch units 12 or 14 can be provided with back deck switch units 16 having contacts mounted on the contact deck as shown in FIGS. 19 or 20 to switch in auxiliary coils, or fuses as described hereinafter. Referring to FIG. 3A a single phase switch unit 12 is showing having a back deck unit 16 stacked thereon to provide fuse and/or auxiliary coil connections to the transformer circuits. Dual voltage switches 10 of this type are generally mounted under oil on the inside of the transformer wall 15. The switch is operated from the outside of the wall 15 by means of an operating handle assembly 17.

As is generally understood in the art, the phase switch units 12, 14 are used to connect the three coil segments of a single-phase transformer coil, either in series or parallel, depending on the voltage rating requirement of the transformer. If each coil segment is rated at 2,400 volts, a parallel connection will provide a 2,400-volt rated transformer and a series connection will provide a 7,200-volt transformer. The back deck switch units 16 can be used to connect a low-voltage fuse in the parallel circuit or a high-voltage fuse in the series circuit. In those instances where it is desirable to change the voltage rating in the circuit, auxiliary tap coils can also be added to the transformer circuits by the back deck units 16. It can, therefore, be seen that by stacking the phase switch units, 12 and 14 and the back deck switch units 16 all of the functions required for a change in the voltage rating of the transformer can be accomplished from the single operating handle assembly 17 mounted on the outside of the transformer.

Figure 3:
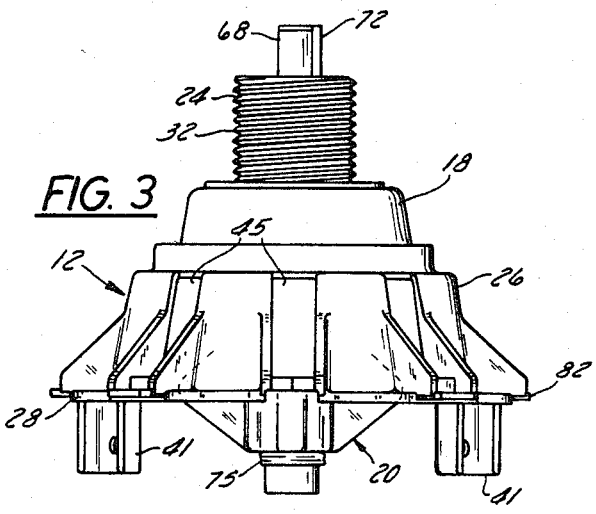
FIG. 3 is an elevation view of one of the switch units used to form the dual voltage switch.
Figure 4:
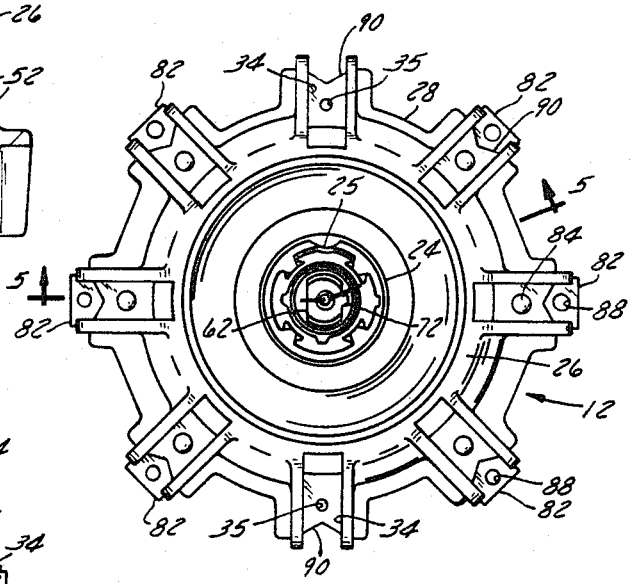
FIG. 4 is a top view of the unit shown in FIG. 3.

In accordance with the present invention, the dual voltage switch 10 has been standardized to use modular switch units formed from the same basic molded parts. In this regard and referring to FIGS. 3, 4 and 6, one of the phase switch units 12 is shown which includes a molded switch block 18, a molded rotor 20, and a molded shaft 22*a*. The rotor 20 is basically identical and interchangeable with the corresponding part in the other switch units 14 and 16 used in the dual voltage switch. However, in the switch units 14 and 16, the switch block 19 and shaft 22 are interchangeable.

SWITCH BLOCK

The switch block 18 for the switch unit 12 is molded in the form of a cup, having a central hub 24, and an annular wall 26, which terminates at a contact deck 28. The hub 24 includes an axial bore 30 and a threaded section 32 on the outside of the hub 24. A locating groove 25 is provided on the threaded section 32. The wall 26 includes a number of all circulating openings 45. The contact deck 28 includes eight contact seats 34 provided at equally spaced intervals, 45 degrees, around the periphery of the deck. Each contact seat includes a mounting hole 35 and a hex lock or keeper surface 90. Stacking brackets 41 having openings 43 are provided on the contact deck 28.

It should be noted that the first switch unit 12 in the stack is provided with the threaded hub 24 in order to mount the stack in the transformer wall 15. All the remaining switch units 14 and/or 16 provided in the stack use a common switch block 19 having a flat wall 36, as seen in FIG. 2, with an axial bore 38. Each switch block 19 is provided with a number of integral spacers 21 having openings 23. Stacking brackets 41 having mounting holes 43 are provided on the side of the deck 28 opposite the spacers 21. Oil circulation openings 45 are also provided in the wall 26 to allow for the free flow of oil through the switch unit.

Figure 8:
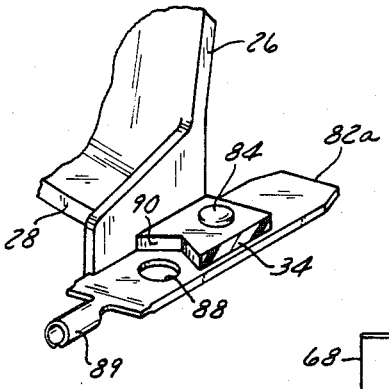
FIG. 8 is a perspective view of a portion of a switch block showing a contact blade support and the hex keeper for the head of the bolts.
Figure 9:
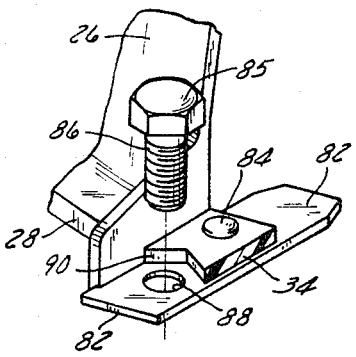
FIG. 9 is a view similar to FIG. 8 showing a hex head bolt in a position to be seated on a contact blade with the hex head held in position by the hex keeper.

Electrical connections to the leads of the transformer coil segments, fuses and/or auxiliary tap coils are provided by means of contact blades 82 (FIG. 9) or 82*a* (FIG. 8) which are mounted on the contact seats 34 on the deck 28 and lie in a common plane. Each contact blade 82 is in the form of a flat conductive strip of metal having a pair of holes 87 and 88, gas seen in FIG. 5. Each blade 82 extends inwardly a distance from the wall 26 and is secured to the contact seat by means of a rivet 84 which passes through the mounting hole 35 (FIG. 6) and the holes 87 in the blades 82. The blades 82 can be connected to the coil segment leads by means of hex head bolts 86 which are positioned in holes 88 as seen in FIG. 9. Contact blades 82*a*, shown in FIG. 8 include integral barrel terminals 89 as well as bolt holes 88 and mounting holes 87. The number of contact blades 82, 82*a* provided on each contact deck will depend on the function performed by each switch unit in the stack forming a dual voltage switch as described hereinafter.

Means are provided on the contact seats 34 to engage and lock the hex head 85 of the bolts 86 in a fixed position when a nut is tightened onto the bolt. Such means is in the form of the V-shaped surface 90 provided on the edge of the contact seat 34. The hex head bolt 86 is positioned in the hole 88 in the blade 82 with the hex head 85 abutting the V-shaped surface 90. The head 85 is held against the surface 90 when a terminal nut is turned onto or off the bolt 86.

ROTOR

Figure 7:
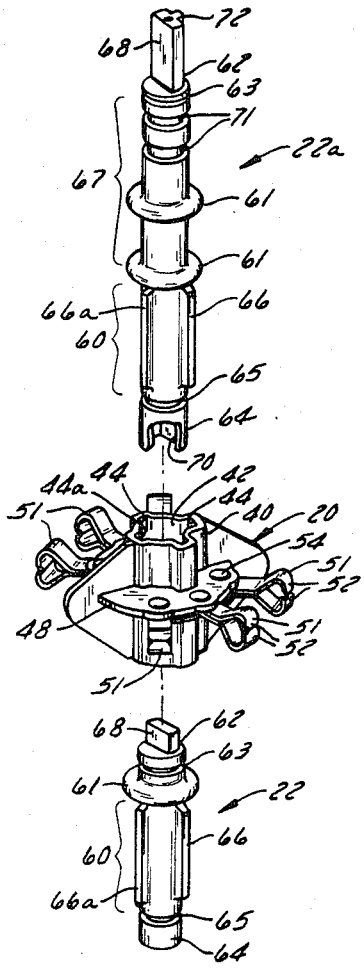
FIG. 7 is an exploded perspective view showing a rotor and the interlocking relation of a pair of shafts.
Figure 5:
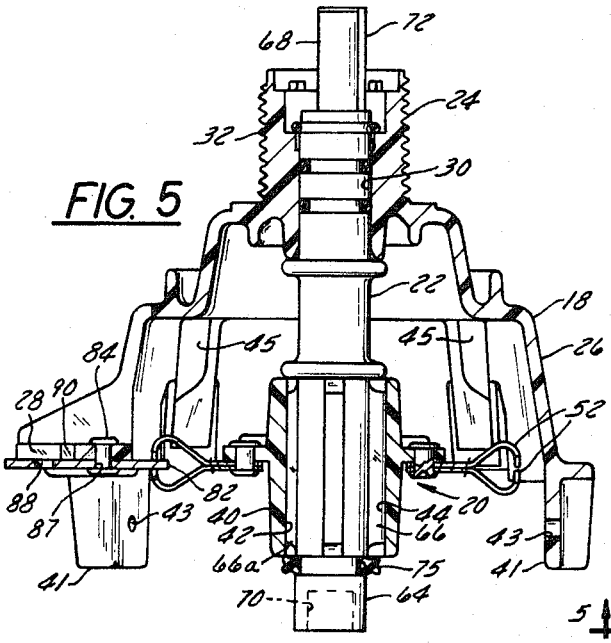
FIG. 5 is a section view taken on line 5—5 of FIG. 4.

The rotors 20, as seen in FIGS. 2, 5 and 7, are in the form of a cylindrical tube 40, having a bore 42 and a number of axial keyways 44 and an index keyway 44*a* having a depth less than the keyways 44. Contact support means in the form of a radial flange 48 is provided around the outer circumference of the cylindrical tube 40 to support a number of bridge contacts 50. Each radial flange includes a number of mounting holes 49.

Figure 6:
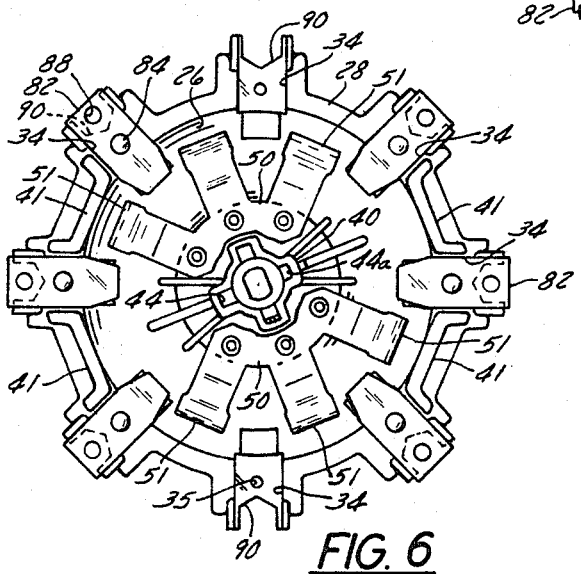
FIG. 6 is a bottom view of the unit shown in FIG. 3.
Figure 10:
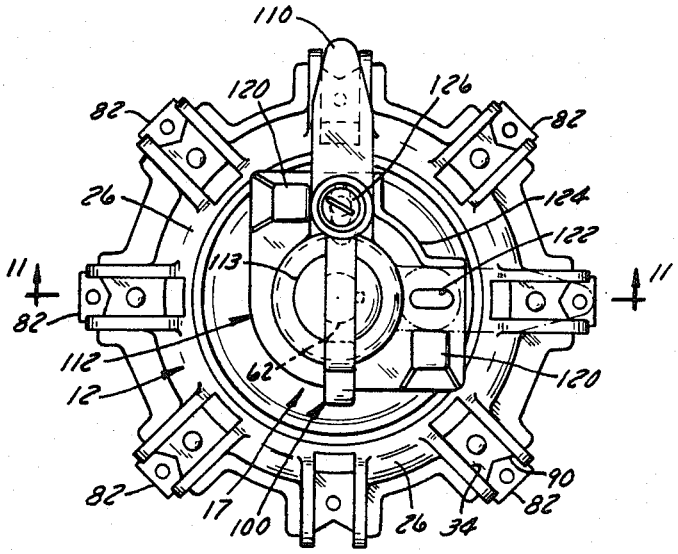
FIG. 10 is a top view of the switch assembly showing the operating handle and index plate.

In this regard, each of the bridge contacts 50 includes a number of pinch type contact fingers 51 which interconnect the blades 82 through the bridge. In a phase switch unit three fingers 51 are provided on each bridge contact, as seen in FIG. 6. In the fuse or auxiliary units two fingers 51 are provided on each bridge contact as seen in FIG. 7. Each of the fingers 51 is in the form of a double blade having a curved contact 52 at the end of each blade. The edges of the curved contacts 52 are located a distance apart less than the thickness of the blades 82 or 82*a* and are contoured at the edges to slide over the blades 82. The bridge contacts are secured to the radial flange 48 by means of rivets 54 which pass through holes 49 with the fingers 51 arranged in a common plane.

Referring to FIG. 5, means are provided for positively engaging the bridge contacts 51 with the blades 82 or 82*a*. Such means is provided by the inherent bias of the blades 51 when the contacts 52 are forced outward by the blades 82 or 82*a*. More particularly, on rotation of the edges of the curved contacts 52 into engagement with the contact blades 82 the curved ends 52 of the fingers are forced outward providing a positive engagement with the blades 82.

Means are provided for reducing the force required to rotate the fingers 51 into engagement with the blades 82 or 82*a*. This is accomplished by staggering the fingers 51 so that the fingers engage the blades 82 in sequence rather than simultaneously. As pointed out above, the blades 82 are spaced at 45 degree intervals. The fingers 51 are spaced at 47 degree intervals. On rotation of the rotor counterclockwise in FIG. 6, the lead finger 51 on each bridge contact 50 will engage a contact blade 82 before the next finger comes into contact with a second blade 82. In the two degrees of rotation required to bring the second finger into contact with a contact blade, the curved ends 52 of the first finger will be opened on engagement with the first contact blade 82. With this arrangement, the force required to rotate the rotor will be reduced to the force required to open one set of fingers on each rotor in the stack at a time.

Means are required to compensate for misalignment of the bridge contacts 50 with the blades 82. Referring to FIG. 5, the plane of the bridge contacts 50 is in the same plane as the contact blades 82. If the plane of the bridge contacts 50 is not coplanar with the plane of the blades 82, additional force would be required to rotate the rotor. This has been alleviated by allowing the rotor 20 to move axially on the shaft 22 on engagement of the fingers 51 with the contact blades 82 thereby compensating for any variation in tolerance of the molded parts.

Figure 18:
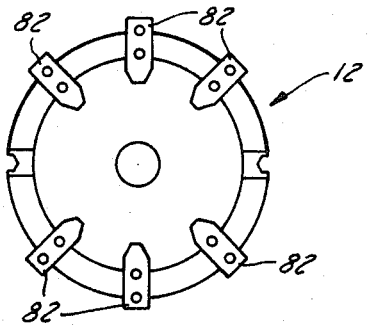
FIG. 18 is a view of the bottom of a switch block showing the contact blade deck for a series-parallel phase switch.

The number of contact blades 82 or 82*a* provided on the contact deck 28 will vary with the function each switch unit performs in the dual voltage switch. More particularly, and referring to FIGS. 18, it should be noted that six contact blades 82 are shown for the phase switch units 12, 14. As described above, the six contacts are cross connected so that the bridge contacts in one position provide a parallel connection and in the other position a series connection. In FIG. 19, four contact blades 82 are shown mounted on the contact decks for a fuse switch unit 16. In FIG. 20 eight contact blades 82 are mounted on the contact deck of the switch unit 16 to provide connections for a double set of high and low fuses or one set of fuses and an auxiliary coil.

Figure 21:
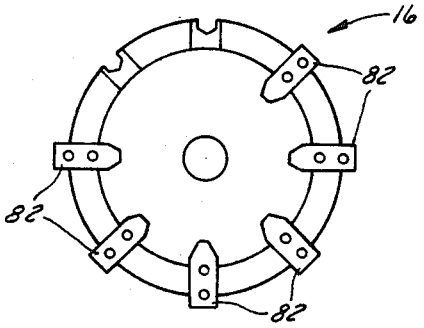
FIG. 21 is a view of a back-deck contact blade arrangement for a tap changer.

In FIG. 21 a contact deck is shown which can be used for a tap changer or a triple voltage switch. Six contact blades 82 are mounted on the contact deck 28 to provide five tap positions or three voltage positions as described hereinafter

SHAFT

The shafts 22, 22*a* for the switch units are provided with a rotor section 60, a drive section 62 and an interlock section 64 as seen in FIG. 7. The rotor section 60 on each shaft is provided with a number of axial ribs 66 and an index rib 66*a* which correspond to the keyways 44 and the index keyway 44*a* in the rotor 20. It should be noted that the index rib 66*a* extends outwardly a radial distance less than the ribs 66 so that the ribs 66 will only fit in the keyways 44.and index rib 66*a* will only fit in the index keyway 44*a*.

The drive section 62 on each of the shafts 22, 22*a* has a generally rectangular configuration which will interlock with a corresponding opening 70 provided in the interlock section 64 on the next shaft. In this regard and referring to FIGS. 2 and 7, the drive section 62 on the shaft 22 in the switch unit 14 is shown positioned in the opening 70 in the lower end of the shaft 22*a* in the unit 12. Also, the drive section 62 of the shaft 22 in the second switch unit 14 is shown positioned in the opening 70 in the section 64 of the shaft in the first switch unit 14. This arrangement provides a positive interlock between the shafts in adjacent switch units so that the shaft rotates as a single unit through the switch.

The shaft 22*a* of the first switch unit 12 requires an extension 67 between the rotor section 60 and drive section 62 to accommodate the operating handle, as described hereinafter. Means are also provided on the extension 67 to seal the switch in the transformer. Such means is in the form of a number of O-ring seals 69 provided in grooves 71 in the extension 67.

The drive section 62 on the shaft 22*a* for the switch unit 12 is extended to accommodate the operating handle assembly 17. Means are provided on the drive section 62 to interengage with the operating handle assembly in the form of an index key 72. Each shaft 22, 22*a* is also provided with a limit stop in the form of an annular flange 61 and a pair of mounting grooves 63 and 65 as more particularly described below.

The switch units are assembled by initially mounting a rotor 40 on a shaft 22 with the rotor in abutting engagement with the flange 61. The rotor 40 will not fit on the shaft 22 unless the key 66*a* is properly aligned with the keyway 44*a* in the rotor. The rotor 40 is held on the shaft 22 by means of an elastomeric retainer ring 75 positioned in the groove 65. It should be noted that the rotor 40 is free to move axially on the shaft to accommodate variations in tolerances between the rotor and the blades 82 on the contact deck 28 as described above.

The drive section 62 of the shaft is then inserted either into the bore 30 in the hub 24 in the switch block 18 or the opening 38 in the wall 36 of the switch block 19. The shaft is retained in the switch block by means of a retainer ring 75 positioned in the groove 63.

After the switch units 12, 14 and 16 have been assembled they are stacked by aligning the spacers 21 on the switch blocks 19 in the brackets 41 of the adjacent switch blocks and inserting the drive sections 62 into the opening 70 in the adjacent shaft. When properly aligned, screws 47 or rivets are inserted through holes 23 and 43 to lock the spacers in its brackets.

OPERATING HANDLE ASSEMBLY

Means are provided for rotating the rotors 40 in the switch units to connect the coil segments in a series, or parallel relation. Such means is in the form of the operating handle assembly 17 mounted on the drive section 62 of the first-phase unit 12. Referring to FIGS. 10 through 14, the handle assembly 17 generally includes an operating handle 100 and an index plate 112. The handle 100 is formed by a central hub 102, a U-shaped loop 108 and a pointer 110. The hub 102 includes a bore 104 and an index groove 106 extending axially through the bore. The U-shaped loop 108 is connected to the hub 102 to aid in rotating the shafts 22 for the rotors. The pointer 110 extends radially outward from the loop 108 to visibly indicate the position of the handle assembly.

A positive indication of the location of the rotors 40 in the switch units is provided by means of the two position index plate 112. The index plate 112 includes a base 114 having a central opening 116, a locating tab 117 and a depending flange 118. A pair of limit stops 120 and locating holes 122 are provided on the base 114. Positive alignment of the operating handle 100 on the index plate is provided by means of a skirt 124 located on the base 114 between the locating holes 122.

Figure 12:
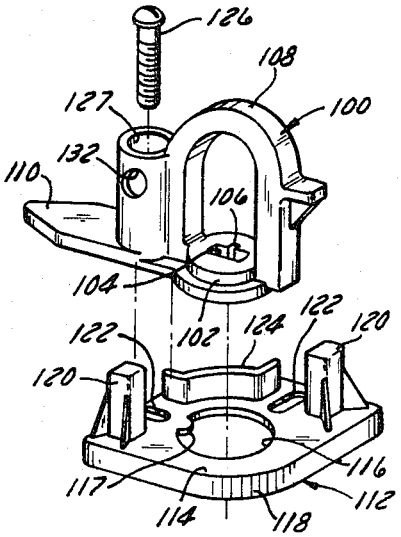
FIG. 12 is an exploded perspective view of an operating handle and index plate.
Figure 12A:
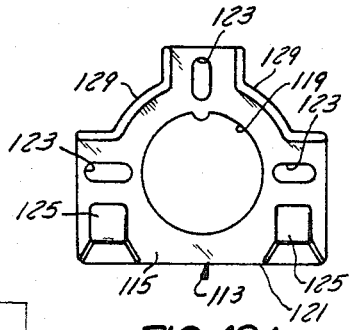
FIG. 12A is a perspective view of a alternate form of index plate.
Figure 11:
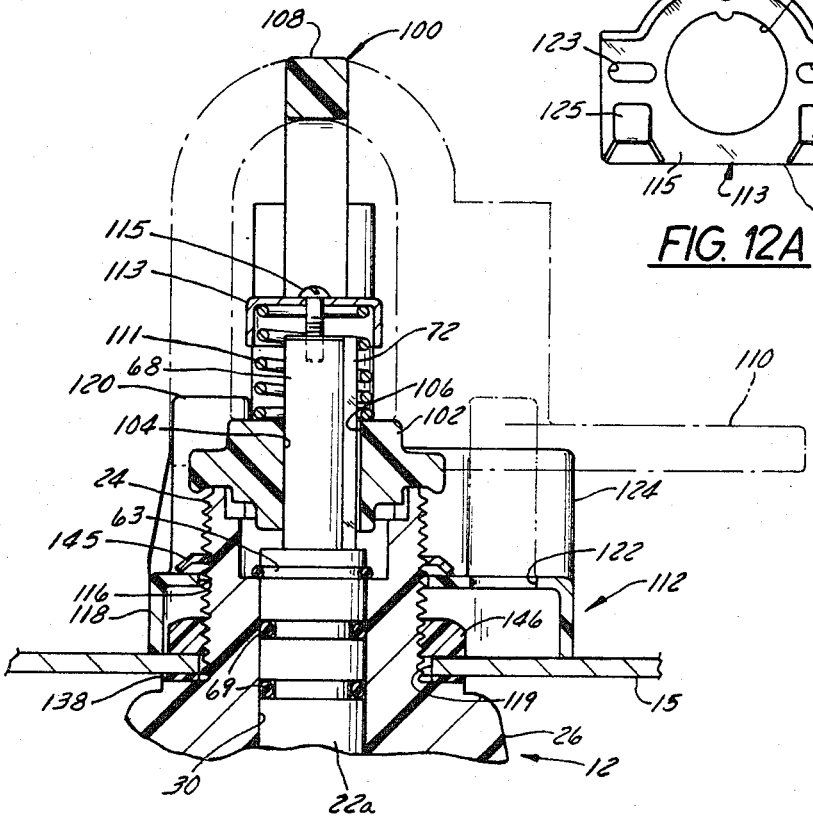
FIG. 11 is a section view taken on line 11—11 of FIG. 10.

If a three voltage switch, i.e., 7200X2400X 7620, is desired a three position index plate 113 as shown in FIG. 12A can be used. The plate includes a base 115 having a central opening 119 and a depending flange 121. Three locating holes 123 are provided in the base. Two limit stops 125 are provided on the base to prevent rotation of rotors beyond the end positions. Positive alignment of the operating handle is provided by the skirts 129 located between holes 123 as described above.

On assembly, the dual voltage switch 10 is installed in a transformer by placing hub 24 of switch unit 12 in the opening 119 in the tank wall 15. It should be noted that a gasket 138 is placed on the base of the threaded hub 24 to seal the switch block 12 in the tank. A lock nut 145 is mounted on the threaded section 32 of the hub 24 to draw the switch block 12 into tight engagement with the gasket 138 on the transformer wall 15. The index, plate 112 is mounted on the hub 24 with the tab 117 (FIG. 12) aligned in a groove 25 provided in the side of the hub 24. The index plate 112 is secured to the transformer wall 15 by means of a lock nut 145.

Figure 13:
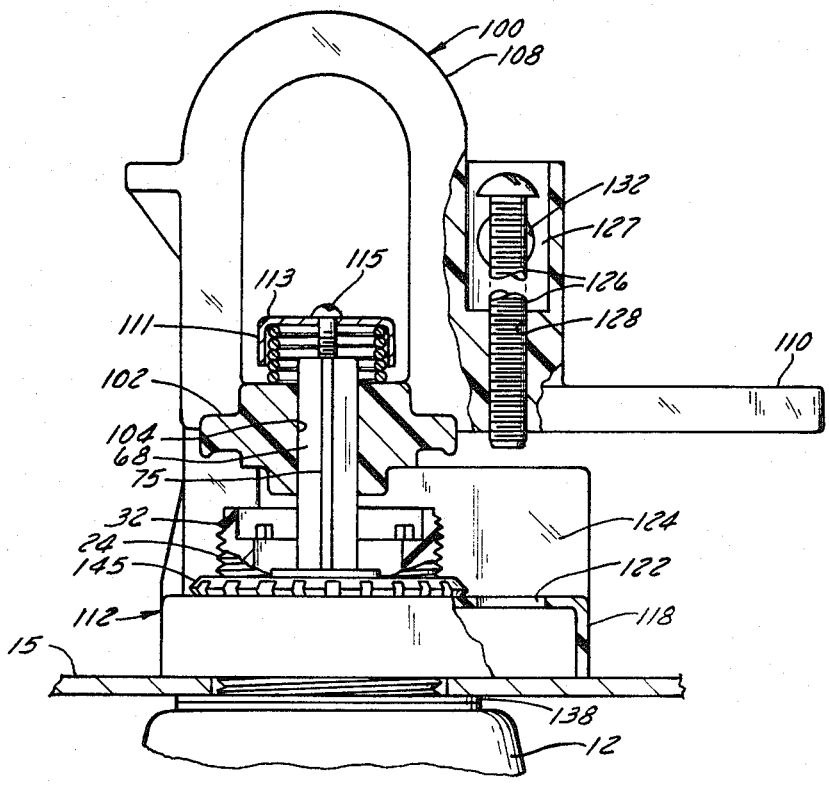
FIG. 13 is an elevation view partly in section showing the operating handle pulled outward to the reset position.
Figure 14:
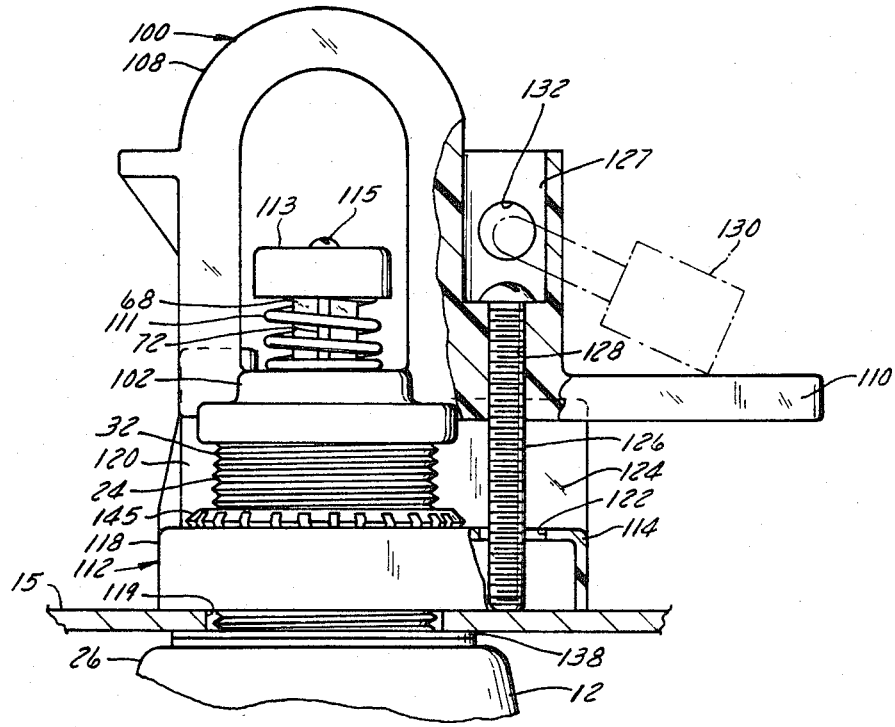
FIG. 14 is a view similar to FIG. 13 showing the handle set in position in the index plate and locked in position.

The operating handle 100 is mounted on the shaft extension 68 by aligning the keyway 106 in the bore 104 with the key 72 on the shaft extension 68. The hub 102 is pushed onto the shaft extension 68 into abutting engagement with the hub 24. The handle 100 is biased by means of a spring 111 against the hub 24. The spring 111 is retained on the shaft by a cap 113 secured to the shaft extension 68 by a screw 115. As seen in FIG. 13, the operating handle 100 must be pulled outward far enough for the pointer 110 to clear the skirt 124 on the index plate. The handle 100 can then be rotated to engage the opposite limit stop 120. On release of the handle 100, the bias of spring 111 will move the handle toward the index plate. If the pointer has not been rotated far enough to clear the skirt 124, the handle can not return, indicating that the handle has not been rotated far enough to close all of the switches.

A back up or redundant indication of the location of the pointer 110 is provided by means of a screw 126 provided on the handle 100. The screw 126 is mounted in an opening 127 having a threaded portion 128 provided on the side of loop 108. The screw 126 when turned fully into the threaded portion 128 will extend into the opening 122 in the index plate 112. If the handle is pulled outward, the screw will not clear the opening 122. In order to rotate the handle, the screw 126 must be backed off out of the threaded portion 128 for enough to clear the base 114 of the index plate.

The operating handle assembly 17 can be secured by means of a padlock 130 to prevent tampering of the dual voltage switch 10. This is accomplished by providing a cross bore 132 through opening 127. When the screw 126 is turned fully into the threaded portion 128, and the padlock 130 is locked in the cross bore, it will be impossible to rotate the operating handle.

Figure 15:
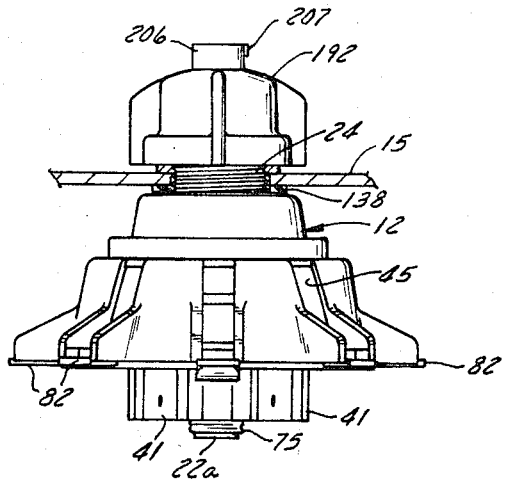
FIG. 15 is an elevation view showing a portion of the switch assembly with a cap type operating handle.
Figure 17:
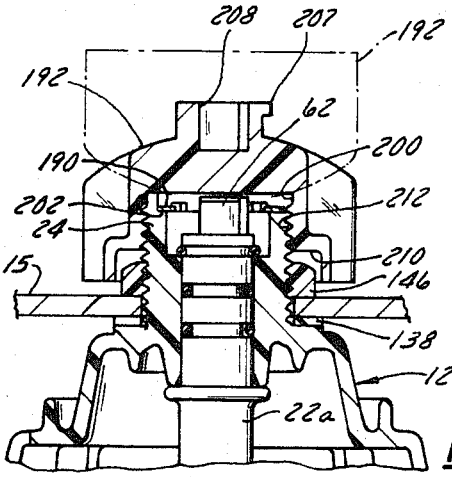
FIG. 17 is a cross section view of the cap type operating handle of FIG. 15.
Figure 16:
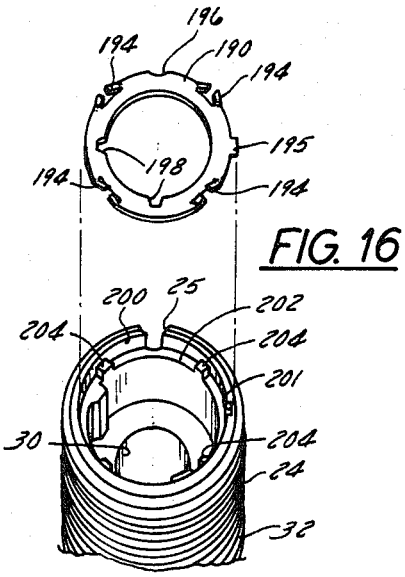
FIG. 16 is an exploded perspective view of a portion of the top of the unit shown in FIG. 15 showing another form of index plate.

An alternate embodiment of the operating handle assembly is shown in FIGS. 15, 16 and 17. In this embodiment, a unique mounting procedure is used to positively locate an index ring 190 in the hub 24 of the switch unit 12. A cap 192 can then be used to rotate the shafts 22 of the switch. The index ring 190 includes a number of positioning tabs 194, a locating tab 195, locating notch 196 and a pair of index notches 198.

The hub 24 is modified to accommodate the index ring 190 by providing a counter bore 200 at the open end of the bore 30 which terminates at a shoulder 202. Four locating nibs 204 are provided on the top of the shoulder 202 and locating groove 201 is provided in the wall of the counter bore. The index ring 190 is placed in the counter bore with the notch 196 aligned with the groove 25 provided in the side of the hub 24, the tab 195 in groove 201 and the positioning tabs 194 positioned on the nibs 204. The ring can then be pressed into place in the counter bore to lock the ring in place. To assure a rigid fit, the upper end of the hub 24 may be heated to soften the plastic material forming the hub so that it can be squeezed slightly to form around the outer edge of the index ring. The ring will then be rigidly locked into the counter bore of 202 in the hub 24.

The switch is operated by means of the cap 192 which includes an interlocking section 206 having a contoured opening 208 corresponding to the configuration of the drive section 62 on shaft 22 and a locating tab 207. The cap 192 also includes a hollow interior 210 having a threaded section 212 to mate with threads 32 on the hub 24. The cap 192 (FIG. 15) is normally stored on the hub 24 by screwing the threaded hub section 212 onto the threaded section 32. In use, the cap 192 is removed from the hub 24, inverted and the tab 207 (FIG. 17) aligned with one of the index notches 198 in ring 190. On insertion of the of the cap into the index ring 190, if the opening 208 does not fit on the section 62, the cap should be turned to align the tab 207 with the other notch 198. Once the cap 192 has been positioned on the drive section 62, the cap 192 is rotated until the tab 207 is aligned with the other index notch 198. It should be noted that the cap 197 can only be removed from the hub 24 when the tab 207 is aligned with one of the notches 198.

Figure 22:
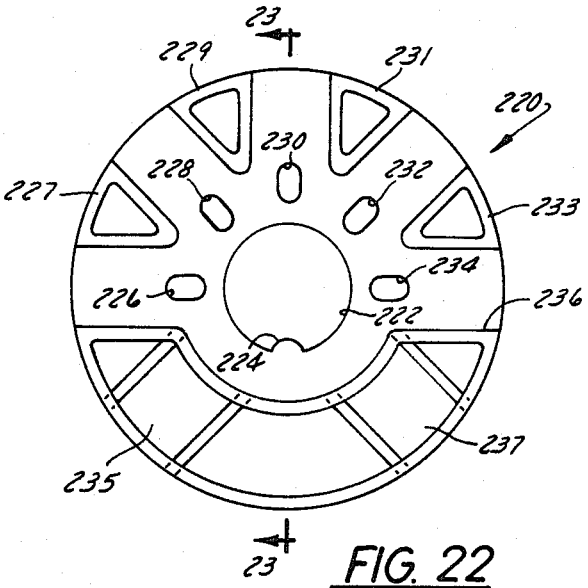
FIG. 22 is a top view of an index plate for a tap changer switch unit.
Figure 23:
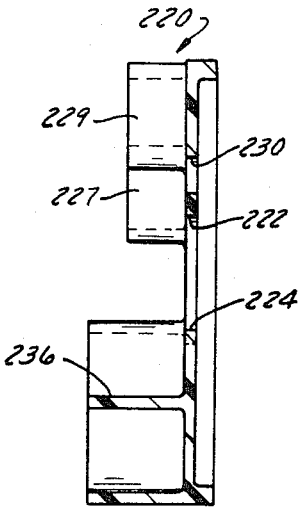
FIG. 23 is a cross-sectional view of the index plate taken on line 23—23 of FIG. 22.

If the switch unit 12 is to be used as a tap changer, then the index plate 220 shown in FIGS. 22 and 23 should be substituted for the index plate 112. All of the other parts of the switch unit will remain the same with the exception of the contact blades 82 which should be as shown in FIG. 21. The tap changer rotor is provided with a bridge contact 50 having two fingers 51. With this arrangement, five tap changer positions are available.

The index plate 220 includes a central opening 222 having a locating tab 224. Five openings 226, 228, 230, 232, 234 are provided for each position of the operating handle 100. The openings are separated by barriers 227, 229, 231 and 233. The operating handle 100 has to be pulled far enough away from the switch to clear the barriers when rotating from one position to the next as described above. A central barrier 236 is provided in the back of the plate to prevent rotation of the operating handle past the outside positions 226 and 234. If additional positions are required, knock out sections 235 and 237 are provided on each side of the barrier 236. These sections shown dotted are removed to add a step on each side of the barrier 236. All of the other parts of the switch unit will remain the same with the exception of the contact blades 82 which should be as shown in FIG. 20.

The embodiments of the invention in which an exclusive property or privilege is claimed, are defined as follows:

1. A dual voltage transformer switch for connecting the winding segments of a transformer coil in a parallel or series relation, said switch comprising a number of switch units each including a switch block having a number of contact blades mounted thereon, said blades being adapted to be operatively connected to the winding segments, a rotor mounted within said switch block, contact means mounted on said rotor for operatively interconnecting said contact blades, said contact means including at least one bridge contact mounted on said rotor, said bridge contact including a number of double bladed fingers having curved contacts at the outer ends positioned for engagement with said contact blades, a shaft mounted for rotary motion in said switch block, said curved contacts being spaced apart a distance less than the thickness of said contact blades whereby the inherent bias of said double bladed fingers will provide a positive electrical contact with said contact blades, a shaft mounted for rotary motion in said switch block, said rotor being mounted on said shaft, and an operating handle assembly mounted on one end of said shaft for rotating said rotor between first and second positions wherein said contact blades are connected in a series relation in one position and a parallel relation in the other position, said assembly including an index member mounted on said switch block, said index member including means for positively locating the position of said rotor in one of the positions in said switch block.

2. The transformer switch according to claim 1 wherein said handle assembly includes an operating handle mounted for axial movement on said shaft, said handle including means cooperating with said index member to visually indicate the position of said rotor in said switch block.

3. The transformer switch according to claim 1 wherein said handle assembly includes a cap having an interlocking section for engaging said shaft and an index tab on said section, said index member comprising an index ring mounted in said block and having index notches indicating the switch positions of the rotor whereby said cap cannot be removed from said shaft unless said index tab is aligned with an index notch.

4. The transformer switch according to claim 3 wherein said ring is rigidly secured to said block by reheating and reforming the switch block material around said ring.

5. The transformer switch according to claim 1 wherein said rotor is free to move axially on said shaft to compensate for differences in the planar position of said bridge contacts with respect to said contact blades.

6. The transformer switch according to claim 1 wherein said switch block includes a central hub having an axially extending bore and a locating groove on the outside of said hub, said shaft being mounted in said bore and having a drive section and a rotor section, said drive section including an index key, said rotor section including an index rib, said rotor including an axial bore and an index keyway in said bore, said rotor being mounted on said shaft with said index rib aligned in said index keyway, said index member being mounted on said hub and including an index tab positioned in said locating groove in said hub and said handle assembly including an operating handle mounted on said drive section and including an index groove aligned with said index key and a pointer to indicate the position of the handle with respect to the index member, whereby said operating handle, shaft and rotor are indexed together in a predetermined relation and said index member and switch block are indexed together in a predetermined relation, the pointer indicating the position of the rotor in the switch block.

7. The switch according to claim 1, including one or more phase switch units.

8. The switch according to claim 1 wherein, each of said bridge contacts include fingers spaced apart a distance slightly greater than the distance between said contact blades.

9. The switch according to claim 1, including spacer means formed as an integral part of said switch blocks for stacking said switch blocks in a fixed relation.

10. An under oil dual voltage transformer switch comprising a number of switch units stacked on a common axis, each switch unit including a switch block having a contact deck and a number of electrical contact blades mounted in a common plane on said deck in a spaced relation radially outwardly from the axis of the block, a shaft mounted for rotary motion in said switch block, a rotor mounted on said shaft, said rotor including a number of bridge contacts having two or more contact fingers mounted in a common plane and positioned to engage said contact blades on said deck, said rotors being free to move axially on said shafts whereby said bridge contacts can move into the plane of the contact blades, said shaft including means for interlocking one shaft the next shaft in the stack, an operating handle operatively connected to the shaft for rotating the rotors simultaneously between first and second positions in said switch blocks, and an index member mounted on the switch block for locating said handle in one of said first and second positions.

11. The switch according to claim 10 including first means for aligning said operating handle in a fixed position on said shaft, second means for aligning said rotor in a fixed position on said shaft and third means for aligning said index member in a fixed position on said switch block whereby the position of said handle with respect to said index member defines the position of said rotor with respect to said switch block.

12. The switch according to claim 11 wherein said first means comprises an index key on said shaft and an index groove in said operating handle.

13. The switch according to claim 11 wherein the position of the switch handle with respect to the index member provides a visible indication of the position of the rotor with respect to the switch block.

14. The switch according to claims 11 or 12 wherein said second means comprises an index rib on said shaft and an index keyway in said rotor.

15. The switch according to claims 11 or 12 wherein said third means comprises an index tab on said index member and an index groove on said switch block.

16.A switch unit for a dual voltage under oil transformer switch, said unit comprising a switch block having a central bore and a contact deck, a number of electrical contact blades mounted on said deck in a common plane at equally spaced intervals, a rotor positioned within said switch block, a shaft supporting said rotor for rotary motion in said switch block, contact means mounted on said rotor for interconnecting said contact blades on said deck in a first predetermined relation in one position and in a second predetermined relation in a second position, said contact means including a number of electrically conductive bridge contacts, each bridge contact including at least two fingers located at spaced intervals slightly greater than said intervals between said contact blades whereby said bridge contacts will operatively engage said contact blades in sequence on rotation of said rotor, an operating handle connected to said shaft for rotating said rotor in said switch block and an index member mounted on said switch block for positively locating said rotor with respect to said switch block.

17. The switch unit according to claim 16 wherein each of said fingers is formed from two blades, each blade having a curved contact at the end with the ends of the blades spaced apart a distance less than the thickness of the contact blades.

18. The switch unit according to claim 16 wherein said contact deck includes eight contact seats for supporting said blades, each contact seat including a hex head bolt keeper surface for engaging the head of the terminal bolt used to connect the coils to the contact blades.

19. The switch unit according to claim 16 wherein said contact blades include a barrel terminator and a terminal bolt opening.

* * * * *